US010799001B2

(12) United States Patent
Rankin

(10) Patent No.: US 10,799,001 B2
(45) Date of Patent: Oct. 13, 2020

(54) ARTICLE OF LUGGAGE AND METHOD OF ASSEMBLING

(71) Applicant: Travelpro Products, Inc., Boca Raton, FL (US)

(72) Inventor: Robin Cunningham Rankin, Delray Beach, FL (US)

(73) Assignee: TRAVELPRO PRODUCTS, INC., Boca Raton, FL (US)

( * ) Notice: Subject to any disclaimer, the term of this patent is extended or adjusted under 35 U.S.C. 154(b) by 271 days.

(21) Appl. No.: 15/516,547

(22) PCT Filed: May 13, 2015

(86) PCT No.: PCT/US2015/030484

§ 371 (c)(1),
(2) Date: Apr. 3, 2017

(87) PCT Pub. No.: WO2016/053387

PCT Pub. Date: Apr. 7, 2016

(65) Prior Publication Data

US 2018/0235334 A1 Aug. 23, 2018

Related U.S. Application Data

(60) Provisional application No. 62/059,002, filed on Oct. 2, 2014.

(51) Int. Cl.

| | |
|---|---|
| ***A45C 5/14*** | (2006.01) |
| ***A45C 5/03*** | (2006.01) |
| ***A45C 13/36*** | (2006.01) |

(52) U.S. Cl.

CPC ..... *A45C 5/14* (2013.01); *A45C 5/03* (2013.01); *A45C 13/36* (2013.01); *A45C 2005/035* (2013.01)

(58) Field of Classification Search

CPC .. A45C 5/14; A45C 5/03; A45C 13/36; A45C 2005/035

See application file for complete search history.

(56) References Cited

U.S. PATENT DOCUMENTS 1,762,527 A * 6/1930 Robinson ..... B65D 81/3886 383/99
2,440,138 A * 4/1948 Benenfeld ..... A45C 13/36 190/126

(Continued)

FOREIGN PATENT DOCUMENTS

CN 204363181 6/2015
DE 2922733 12/1980

(Continued)

OTHER PUBLICATIONS

International Search Report and Written Opinion, International Application No. PCT/US2015/030484, Filing Date May 13, 2015, dated Aug. 13, 2015, 13 pages.

(Continued)

*Primary Examiner* — Tri M Mai
(74) *Attorney, Agent, or Firm* — Reising Ethington P.C.

(57) ABSTRACT

An article of luggage, a method of assembling the luggage, and a bottom tray are provided. The article of luggage includes a bottom tray, wall and spinner wheels. The method involves forming the bottom tray and connecting the wall to the bottom tray. The bottom tray is made from a unitary construction having wheel wells shaped to receive a spinner wheel.

12 Claims, 16 Drawing Sheets

(56) References Cited

U.S. PATENT DOCUMENTS

| | | | | | |
|---|---|---|---|---|---|
| 5,047,001 | A * | 9/1991 | Willis | A45C 9/00 | 112/475.08 |
| 5,048,649 | A * | 9/1991 | Carpenter | A45C 5/14 | 190/115 |
| 5,113,983 | A | 5/1992 | Workman | | |
| 5,181,590 | A | 1/1993 | Carpenter et al. | | |
| 5,445,267 | A * | 8/1995 | Biafore, Jr. | A63B 55/00 | 206/315.8 |
| 5,529,156 | A | 6/1996 | Yang | | |
| 5,634,538 | A * | 6/1997 | Tsai | A45C 5/14 | 190/126 |
| 5,924,533 | A * | 7/1999 | Cnockaert | A45C 5/03 | 190/109 |
| 6,148,973 | A * | 11/2000 | Chang | A45C 5/14 | 190/115 |
| 6,325,189 | B1 * | 12/2001 | King | A45C 3/001 | 190/119 |
| 7,252,296 | B2 * | 8/2007 | Miyoshi | A45C 5/14 | 280/37 |
| 7,692,107 | B1 | 4/2010 | Shotey et al. | | |
| D742,645 | S * | 11/2015 | Aronoff | D3/318 | |
| 9,549,597 | B2 * | 1/2017 | Meersschaert | A45C 5/03 | |
| 9,675,154 | B2 * | 6/2017 | Tong | A45C 5/02 | |
| 2005/0056510 | A1 * | 3/2005 | Hsieh | A45C 13/04 | 190/18 A |
| 2006/0180422 | A1 * | 8/2006 | Lin | A45C 5/14 | 190/18 R |
| 2007/0175719 | A1 * | 8/2007 | Lai | A45C 5/02 | 190/115 |
| 2009/0000894 | A1 * | 1/2009 | Middup | A45C 5/14 | 190/15 R |
| 2009/0314596 | A1 | 12/2009 | Miyoshi | | |
| 2014/0041978 | A1 * | 2/2014 | Chang | A45C 7/0018 | 190/18 A |
| 2014/0151174 | A1 * | 6/2014 | Briccola | A45C 5/03 | 190/18 A |
| 2014/0166417 | A1 | 6/2014 | De Taeye et al. | | |
| 2014/0216875 | A1 | 8/2014 | Cavalheiro | | |
| 2016/0128442 | A1 * | 5/2016 | Correll | A45C 13/262 | 190/18 A |
| 2016/0206069 | A1 * | 7/2016 | Tong | A45C 5/02 | |

FOREIGN PATENT DOCUMENTS

| | | | | |
|---|---|---|---|---|
| DE | 8904681 | | 8/1989 | |
| DE | 8911249 | | 12/1989 | |
| DE | 102007046362 | A1 * | 4/2009 | A45C 5/14 |
| FR | 2922733 | | 5/2009 | |
| WO | WO03063637 | | 8/2003 | |
| WO | WO03063637 | A2 | 8/2003 | |

OTHER PUBLICATIONS

Mosaic Travel Collection; 1280×720; YouTube (online); Masaic Travel Gear; Nov. 5, 2013; URL: https://www.youtube.com/watch?v=ccRXaaR7GD0.

"Maxlite 3 Exapnadable 21" Spinner Carry on Suitcase Travelpro" http://www.goinginstyle.mobi/products/maxlite-3-expandable-spinner-21-carry-on-suitcase-travelpro, Retrieved on Nov. 28, 2014.

NLDA Video Library, Mosaic Travel Gear, "Mosaic travel collection 1280×720.", Youtube, (Nov. 5, 2013), URL: https://www.youtube.com/watch?v=ccRXaaR7GD0, Retrieved from the Internet on Aug. 4, 2015. Whole video, in particular time intervals 0:08-0:26; 1:57-2:01.

Swedish Search Report for application No. 1750528-0 dated Dec. 11, 2019, 3 pages.

* cited by examiner

ARTICLE OF LUGGAGE AND METHOD OF ASSEMBLING

CROSS REFERENCE TO RELATED APPLICATIONS

This application claims priority of U.S. Patent Application No. 62/059,002 filed Oct. 2, 2014, the contents of which are incorporated herein by reference.

FIELD

The present specification relates generally to luggage and more specifically relates to softside luggage having spinner wheels.

BACKGROUND

Travel is a common human activity and luggage is an important feature of travel. Development of new luggage as well as new methods of assembling luggage is quite active as there is a growing demand for more durable lighter luggage as well as a desire to manufacture the luggage with a high degree of consistency for a low cost. Presently, softside articles of luggage have become very popular for their durability and light weight. In addition, more features such as extendible handles and spinner wheels are becoming more popular. This has naturally resulted in an increase in the number of parts that need to be assembled to form an article of luggage.

FIGS. 16*a*-16*c* show a known luggage structure and assembly process. An internal frame piece 100 or other internal structure has screw holes 102 for attachment of a wheel assembly. The internal frame piece 100 is inserted into a fabric body 104, which may be pre-sewn to a degree of completeness. Typically, several separate internal frame pieces 100 are used. Wheel assemblies, including wheel housings 108 and separately attached wheels 110, are positioned at the outside of the fabric body 104 in proximity to the internal frame pieces 100. Each wheel housing 108 is then carefully aligned with the respective internal frame piece 100 and attached to the internal frame piece 100 using screws 112 that pass through the fabric body 104. Problems with this approach can include a large number of separate pieces, such as one internal frame piece 100 per wheel assembly and the separate wheel housings 108. As well, there can often be difficulty in properly aligning a wheel housing 108 that is outside the fabric body 104 with an internal frame piece 100 that is inside the fabric body 104, which can increase the assembler skill needed and the assembly time required. In addition, the wheel housing 108 and internal frame piece 100 are not in direct hard-surface mating contact and instead have fabric sandwiched therebetween. This can reduce the accuracy of the placement and orientation of the wheels 110, which may result in poor rolling performance of the finished article of luggage.

SUMMARY

In accordance with an aspect of the specification, there is provided an article of luggage. The article of luggage includes a bottom tray having wheel wells formed therein. The bottom tray is made from a bottom-tray material. The article of luggage also includes a wall connected to the bottom tray. The wall is made from a wall material that is softer than the bottom-tray material. In addition, the article of luggage includes spinner wheels connected directly to the bottom tray at the wheel wells.

The bottom-tray material may be a hard plastic.

The wall material may be a fabric.

The bottom tray may be a unitary construction.

The bottom tray may be manufactured using an injection molding process.

The bottom tray may include a lip positioned at least along a portion of a perimeter of at least one of the wheel wells. The lip may be offset from an outer wall of the bottom tray defining a gap. The gap may be configured to fit an edge of the wall material.

The lip may be integral with the bottom tray.

The lip may be removable from the bottom tray.

The lip may be configured to protect a corner of the article of luggage.

The wall material may be shaped to have at least one fastening flap extending from a wall portion of the wall material. The fastening flap may be narrower than the wall portion and wrapped at least partially under the bottom tray. The fastening flap may be secured to an underside of the bottom tray.

In accordance with an aspect of the specification, there is provided a method of manufacturing an article of luggage. The method involves forming a bottom-tray material into a bottom tray having wheel wells configured to receive spinner wheels therein. The method further involves connecting wall material to the bottom tray to form a wall of the article of luggage.

Forming the bottom-tray material into the bottom tray may involve using an injection molding process.

The method may further involve wrapping a fastening flap of the wall at least partially under the bottom tray. The fastening flap may extend from a wall portion of the wall and be narrower than the wall portion.

The method may also involve fitting an edge of the wall into a gap formed between an outer wall of the bottom tray and a lip extending from at least a portion of a perimeter of at least one of the wheel wells.

The method may further involve securing the fastening flap to an underside of the bottom tray.

In accordance with an aspect of the specification, there is provided a bottom tray for an article of softside luggage. The bottom tray is made of unitary construction from bottom-tray material and includes wheel wells formed therein. Each of the wheel wells is shaped to receive a spinner wheel.

The bottom tray material may be a hard plastic.

The bottom tray may be manufactured using an injection molding process.

The bottom tray may further include a lip positioned at least along a portion of a perimeter of at least one of the wheel wells. The lip may be offset from an outer wall of the bottom tray defining a gap fitting an edge of a wall. The lip may be integral with the bottom tray.

The lip may be removable from the bottom tray.

BRIEF DESCRIPTION OF THE DRAWINGS

Reference will now be made, by way of example only, to the accompanying drawings in which.

DETAILED DESCRIPTION OF THE EMBODIMENTS

As used herein, any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components will, in practice, be utilized in orientations that are the same as, or different than those described or shown.

Figure 1:
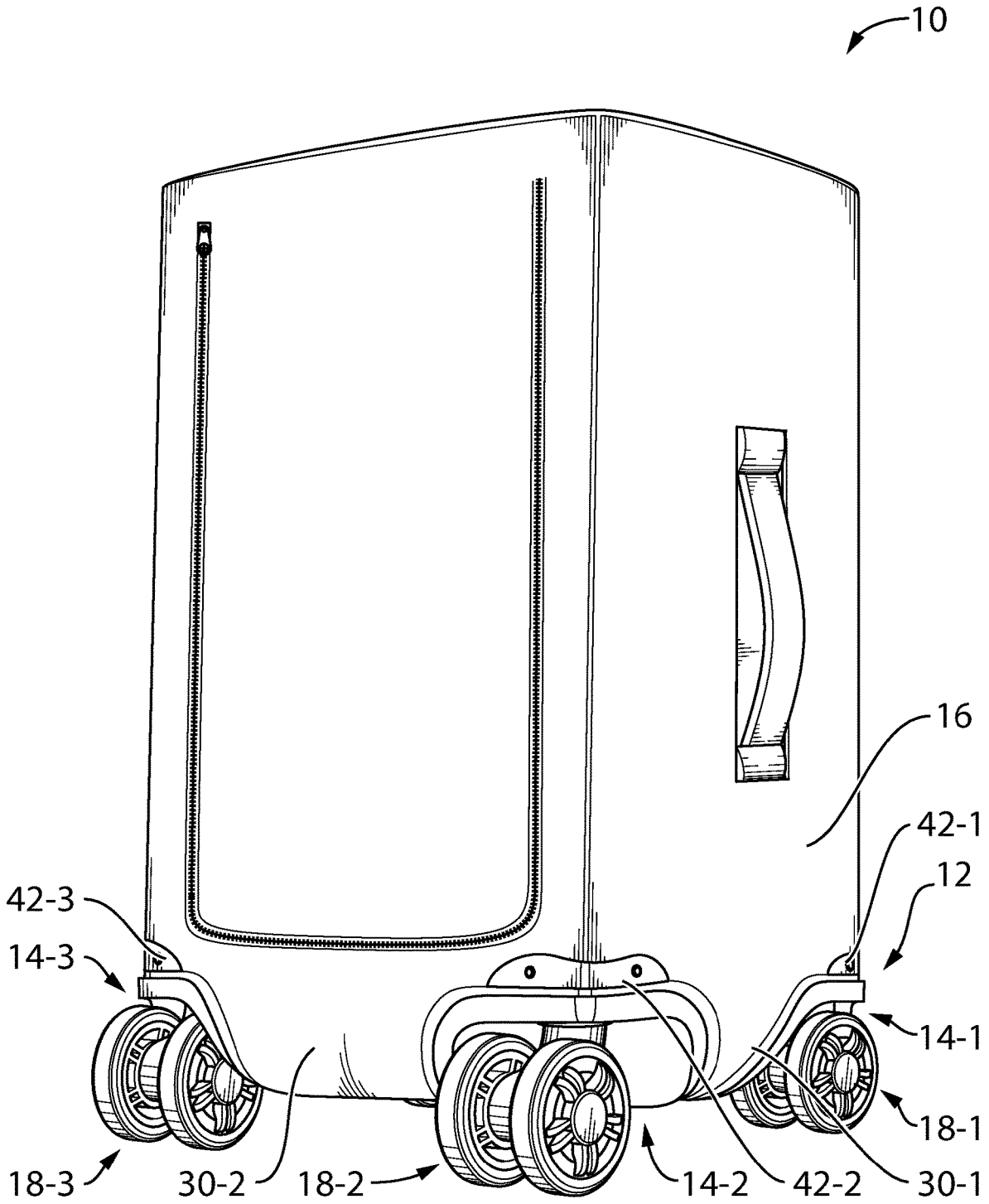
FIG. 1 is a perspective view of an article of luggage according to an embodiment.

Referring to FIG. 1, an article of luggage is indicated generally at 10. It is to be understood that the article of luggage 10 shown is purely exemplary and it will be apparent to those skilled in the art that a variety of different structures are contemplated.

In the present embodiment, the article of luggage 10 includes a bottom tray 12 having a plurality of wheel wells 14-1, 14-2, 14-3, and 14-4 formed therein (generically, these wheel wells are referred to herein as "wheel well 14" and collectively they are referred to as "wheel wells 14"). The article of luggage 10 further includes a wall 16 connected to the bottom tray 12. The term "wall" applies to the front, back, top, and left and right sides of the article of luggage 10, individually or as a whole. In the present embodiment, the wall 16 is connected using a plurality of interlock pieces 42-1, 42-2, 42-3, and 42-4 (generically, these interlock pieces are referred to herein as "interlock piece 42" and collectively they are referred to as "interlock piece 42") at each of the wheel wells 14-1, 14-2, 14-3, and 14-4, respectively, and at the fastening points 40-1 and 40-2 such as screw holes in the bottom tray 12 (generically, these fastening points are referred to herein as "fastening point 40" and collectively they are referred to as "fastening points 40") as described in greater detail below and shown in FIG. 3. The article of luggage 10 further includes spinner wheels 18-1, 18-2, 18-3, and 18-4 (generically, these spinner wheels are referred to herein as "spinner wheel 18" and collectively they are referred to as "spinner wheels 18") directly connected to the bottom tray 12 at the wheel wells 14-1, 14-2, 14-3, and 14-4, respectively. It is to be appreciated by a person of skill in the art that "spinner wheel" is a term of the art and refers to specialized wheels for luggage capable of moving in any direction. The direct connection of the spinner wheels 18 to the bottom tray 12 can provide increased rigidity and better wheel placement/orientation accuracy over what is known in conventional designs in which fabric is sandwiched between wheel structures and internal structure of the article of luggage.

Figure 2:
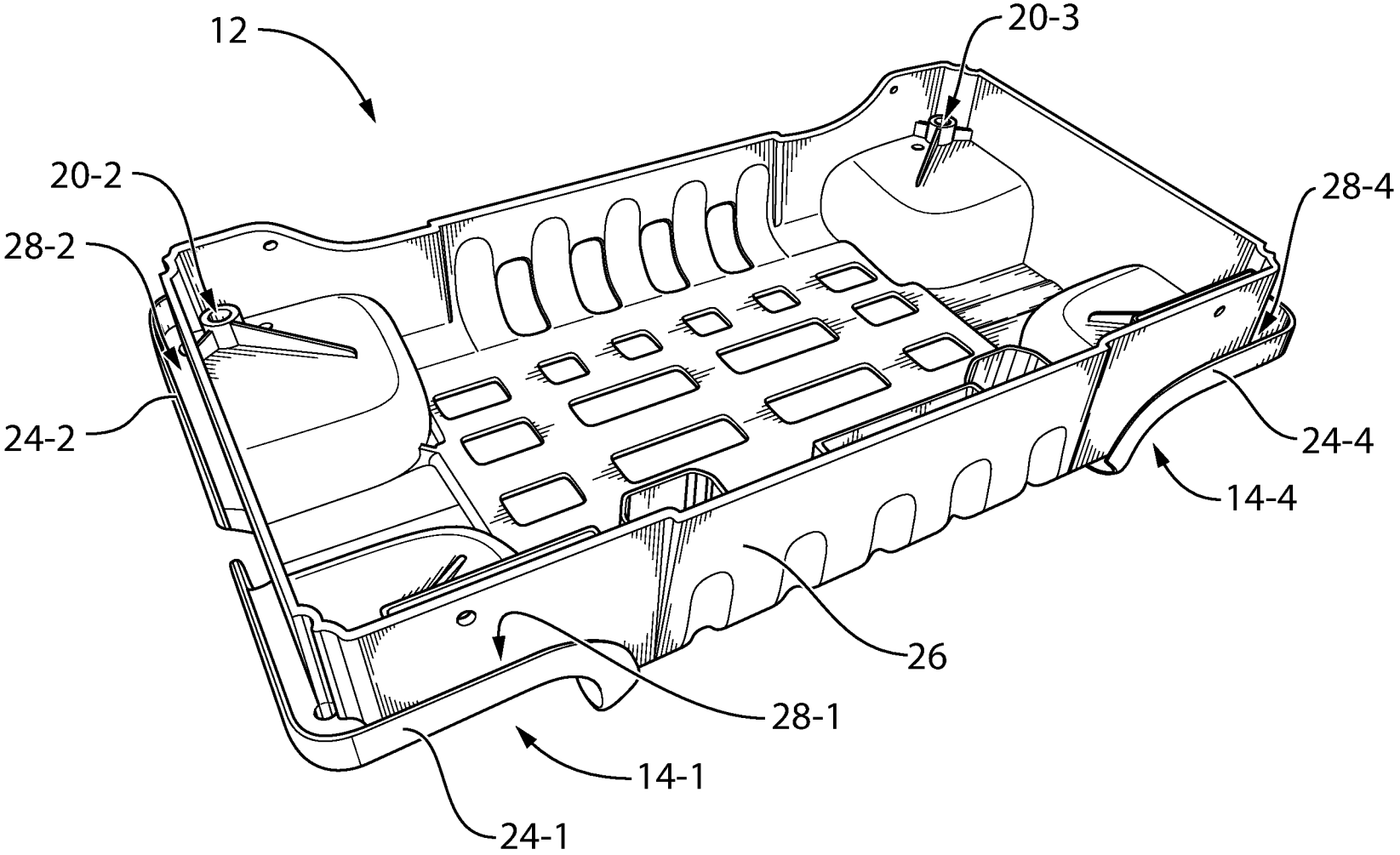
FIG. 2 is a perspective view of a bottom tray according to an embodiment.
Figure 3:
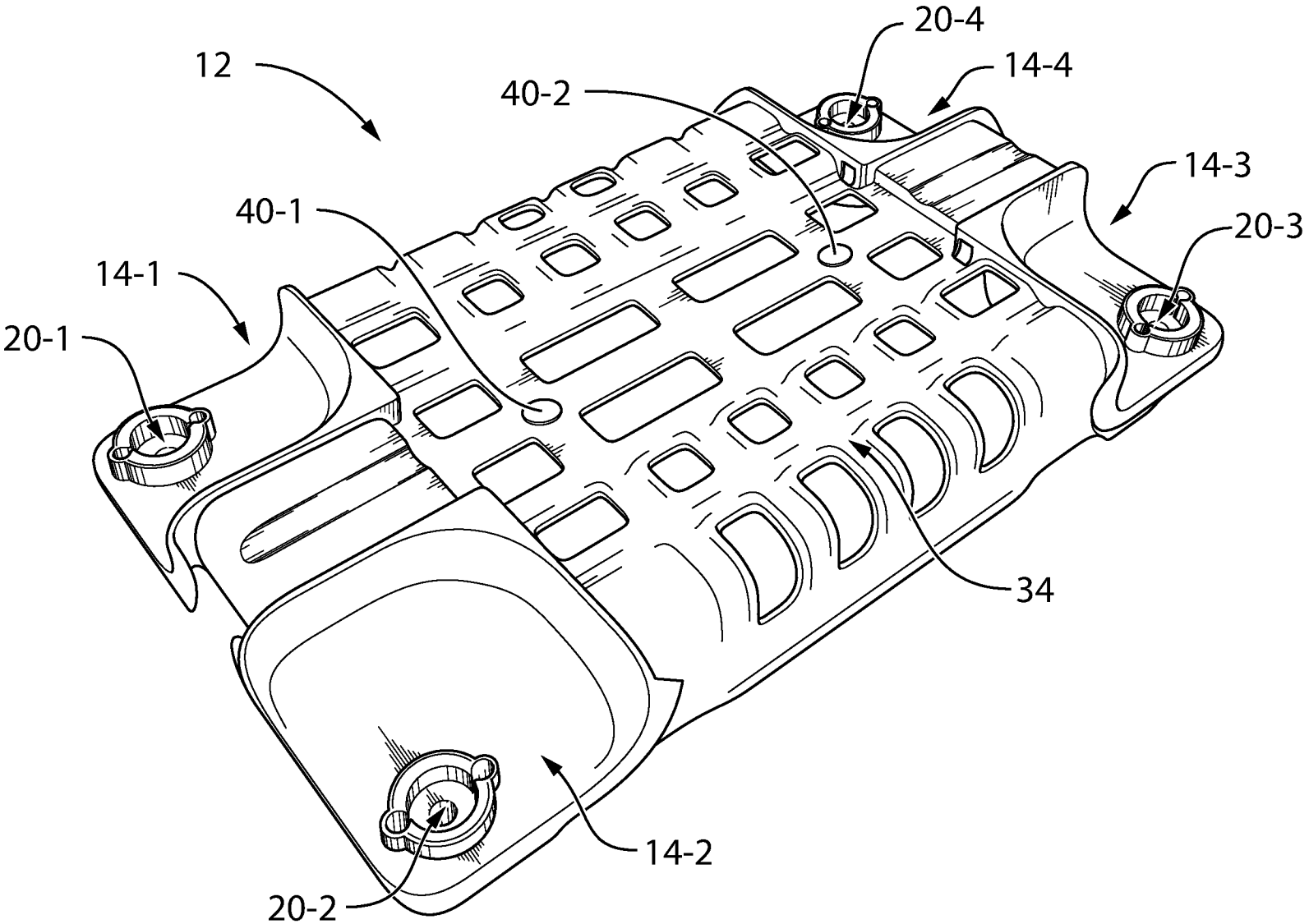
FIG. 3 is another perspective view of the bottom tray according to the embodiment shown in FIG. 2.

Referring to FIGS. 2 and 3, the bottom tray 12 of the article of luggage 10 is shown. The bottom tray 12 is made from a bottom-tray material. In the present embodiment, the bottom-tray material is a hard plastic, such as polyproylene. However, it is to be understood that the bottom tray 12 is not particularly limited to any material and that several variations are contemplated. Some examples of materials which are ideal for the bottom tray 12 are other hard plastics, aluminum, titanium, carbon fiber composites, and other materials commonly used in the manufacture of structural components of luggage. In the present embodiment, the bottom tray 12 has a unitary construction and made using an injection molding process. Alternatively, the bottom tray 12 may include one or more pieces, may be made of one or more materials, and may be formed by one or more various manufacturing techniques, such as pressure forming and 3D printing.

Figure 15:
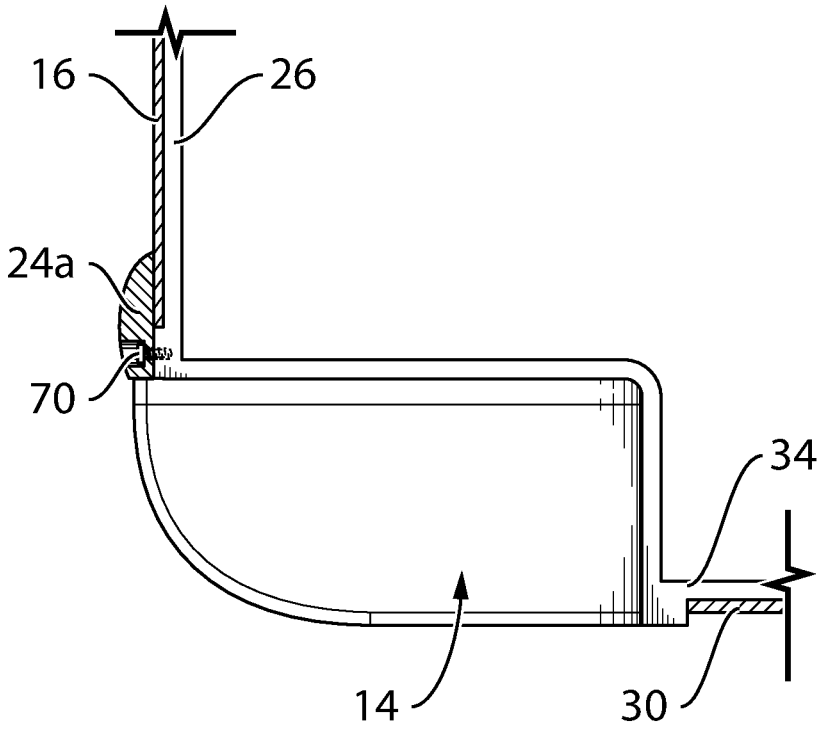
FIG. 15 is a cross section view showing a removable lip.
Figure 16A:
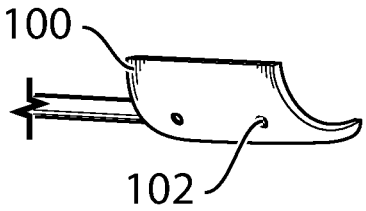
FIG. 16a PRIOR ART
FIGS. 16*a*-16*c* are perspective views of a portion of a conventional article of luggage at different stages of a known assembly process.
Figure 16B:
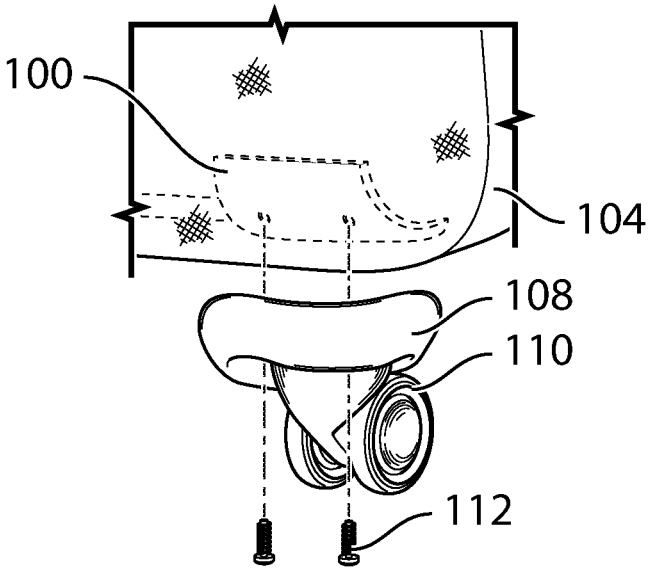
FIG. 16b PRIOR ART
Figure 16C:
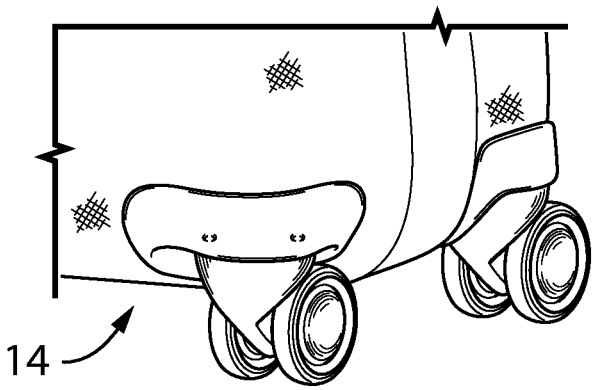
FIG. 16c PRIOR ART

In the present embodiment, the bottom tray 12 includes a plurality of lips 24-1, 24-2, 24-3, and 24-4 (generically, these lips are referred to herein as "lip 24" and collectively they are referred to as "lips 24") positioned along a portion of a perimeter of the wheel wells 14-1, 14-2, 14-3, and 14-4, respectively. Each of the lips 24-1, 24-2, 24-3, and 24-4 is offset from an outer wall 26 of the bottom tray 12 to define a gap 28-1, 28-2, 28-3, and 28-4 (generically, these gaps are referred to herein as "gap 28" and collectively they are referred to as "gaps 28"), respectively, configured to receive an edge of the wall material that forms the wall 16 as discussed in greater detail below. It is to be appreciated by a person of skill in the art having the benefit of this description that the outer wall 26 of the bottom tray 12 is generally covered by the wall 16, while each of the lips 24 is exposed. Accordingly, the lips 24 can be configured to cover and/or secure the edges of the wall 16 as well as configured to provide protection for a corner of the article of luggage 10 from bumps and scratches that the corners of the article of luggage 10 may be subjected to during use. In the present embodiment, the lips 24 are an integral part of the unitary construction of the bottom tray 12. However, variations can include using a different material for the lips 24 such as rubber, different plastics, and other scratch resistant materials to provide even greater protection. Additionally, it is to be appreciated than the lips 24 can also be removable (see FIG. 15) or covered with another material such that the lip 24 or additional material that can be replaced upon being damaged.

The bottom tray 12 further includes a mount point 20-1, 20-2, 20-3, and 20-4 (generically, these mount points are referred to herein as "mount point 20" and collectively they are referred to as "mount points 20") in each wheel well 14-1, 14-2, 14-3, and 14-4, respectively. The mount points are each configured to receive the spinner wheels 18 for mounting. It is to be appreciated with the benefit of this description that the mount points 20 along with the manner by which the spinner wheels 18 are mounted are not particularly limited and can be varied. In the present embodiment, the mount points 20 include a hollow cylindrical neck. However, other embodiment can include other mounting mechanisms such as a clips, magnetic connectors or quick connectors.

In the present embodiment, each of the wheel wells 14 is shaped to at least partially accommodate the respective spinner wheel 18. In the present embodiment, each of the wheel wells 14 defines a concave cavity configured to directly receive the respective spinner wheel 18. It is to be appreciated with the benefit of this description that the depth of the wheel well 14 is not particularly limited and that the wheel well 14 is not necessarily concave in other embodiments. In fact, some embodiments can include a convex wheel well such that the wheels extend further from the wall 16. For example, when the wheel well 14 includes a deep cavity, the wheels 18 are generally further recessed resulting in the external dimensions of the article of luggage 10 being smaller which can be advantageous in some circumstances, such as for satisfying airline luggage size requirements. However, the deeper recess would reduce the interior space of the article of luggage 10 and create irregular features, such as a bump, on the interior walls of the article of luggage 10 making it more difficult to utilize the interior space when loading non-deformable objects. Conversely, having a shallow cavity for the wheel well 14 would allow for the article of luggage 10 to be positioned further above a surface such that the wall 16 would be less likely to touch the surface to reduce the chance that the wall 16 would be damaged or soiled from contact with the surface. In addition, the shallower wheel well 14 would provide interior walls which are flatter and which may facilitate loading of the article of luggage 10.

Figure 4:
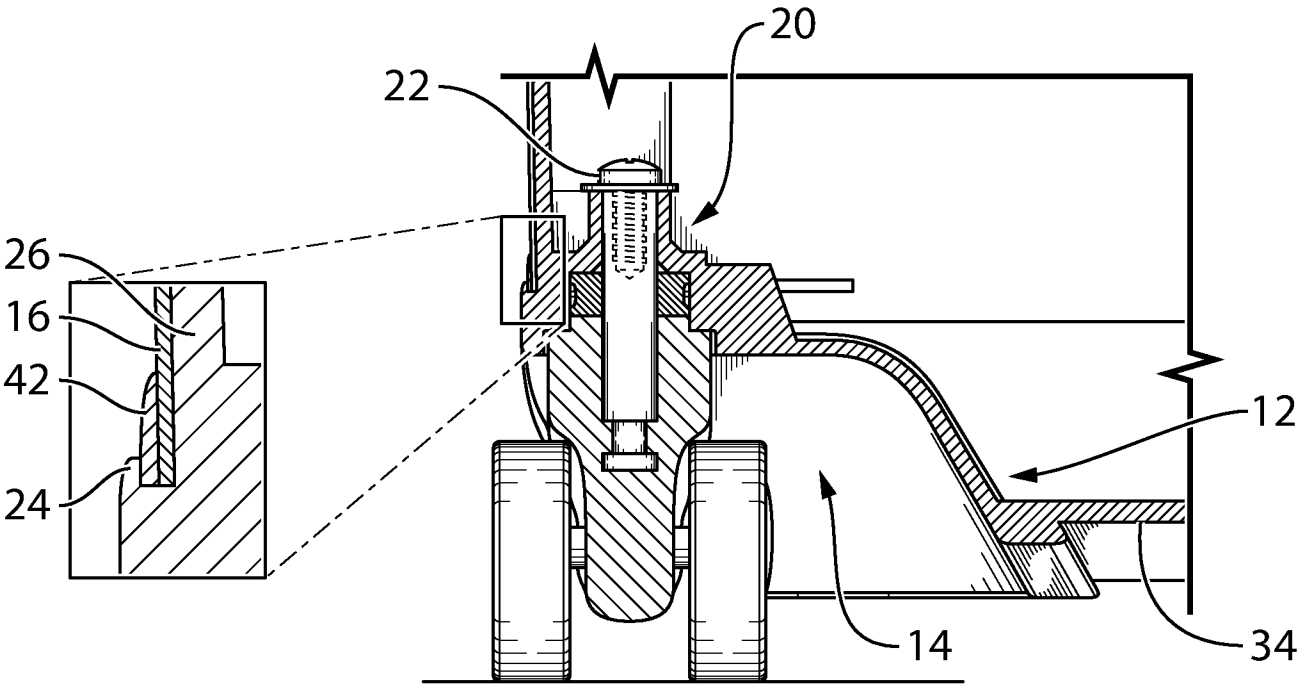
FIG. 4 is a cross section view of a portion of the article of luggage shown in FIG. 1.

The wheel wells 14 are formed in the bottom tray 12 and are monolithically formed with the bottom tray 12. In particular, the wheel wells 14 of the present embodiment are not separate components fastened to the bottom tray 12. It is to be understood by a person of skill in the art that the monolithically formed wheel wells reduce tolerances on the assembly of the article of luggage 10 as well as simplifies the manufacturing process by having fewer pieces to put together at the final assembly step. Referring to FIG. 4, the connection of the spinner wheel 18 to the bottom tray 12 in accordance with the present embodiment is shown. Each wheel well 14 in the bottom tray 12 includes a mount point 20 for affixing a spinner wheel 18. In the present embodiment, the mount point 20 includes a cylindrical neck through which a bolt 22 extends. The bolt 22 is configured to thread into the upper end of the spinner wheel 18. It is to be appreciated by a person of skill in the art with the benefit of this description that variations are contemplated. For example, the mount point 20 can be modified to be a simple hole instead a cylindrical neck. By using a hole as the mount point 20 instead of cylindrical neck, it is to be understood that the interior space within the article of luggage 10 can be increased at the cost of reduced structural rigidity of the spinner wheels 18. As another example of a variation, the spinner wheel 18 can be fastened to the mount point 20 using other means such as with a frictional fit, a c-clip, or rivet.

Referring back to FIG. 3, the underside 34 of the bottom tray 12 can include two fastening points 40-1 and 40-2 for receiving fasteners for securing one or more of the fastening flaps 30-1, 30-2, 30-3, 30-4 (shown in FIG. 5) of the wall 16 to the bottom tray 12. In the present embodiment, each of the fastening points 40 can include a hole for receiving a screw. However, in other embodiments, other types of fastening points 40 can be used. For instance, the fastening points 40 can include screw or bolt holes in a thickened region of bottom-tray material for receiving and guiding a screw, bolt, or similar fastener. In another example, the fastening points 40 can include dimples for centering and guiding a screw. It is to be appreciated by a person of skill in the art with the benefit of this description that other variations are contemplated. The bottom try 12 can be modified to include more fastening points 40, include fewer fastening points 40, or be without fastening points 40, such that the fastening flaps 30 are secured directly onto a portion of the bottom tray using adhesives or another fastening method.

Figure 5:
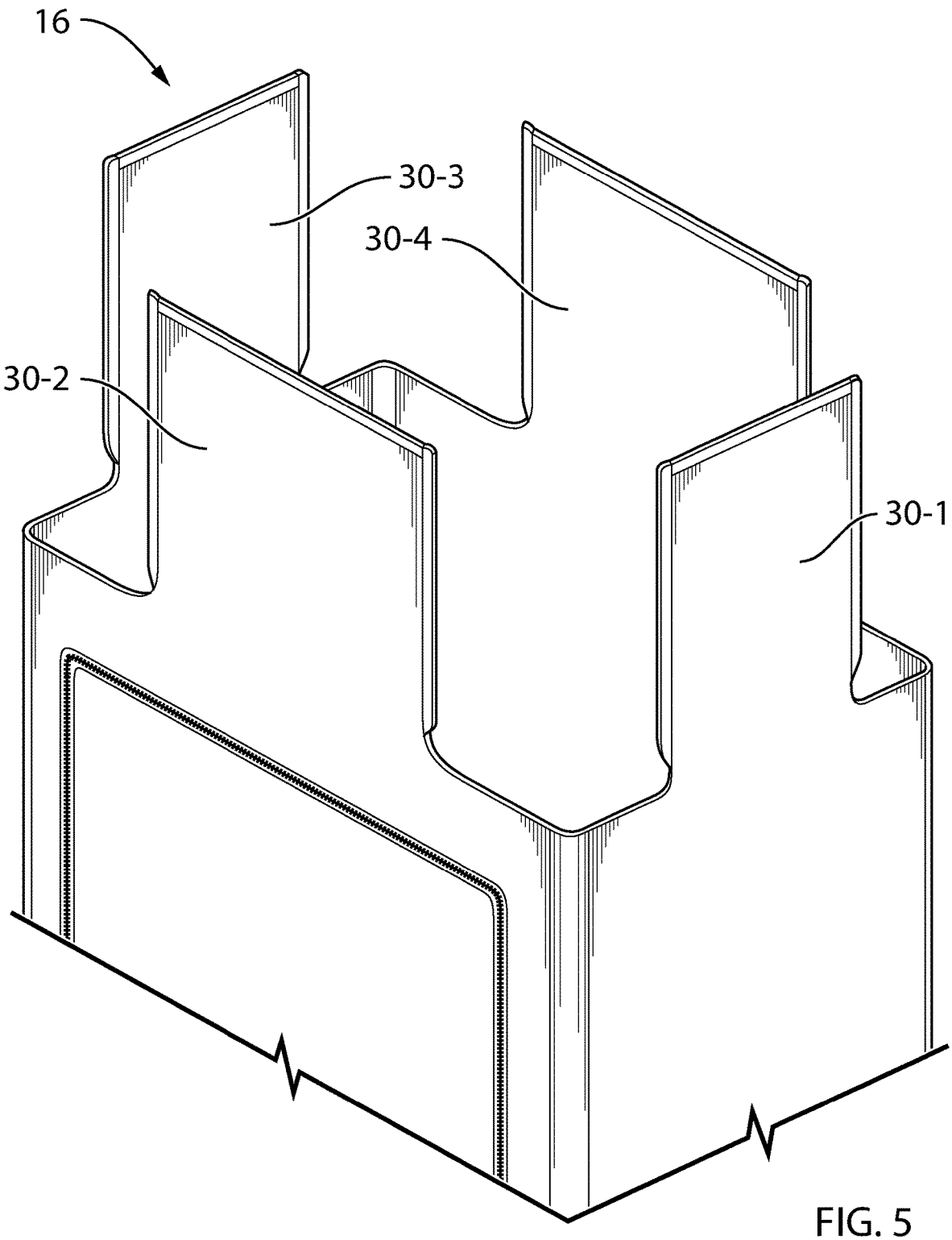
FIG. 5 is a perspective view of a wall according to an embodiment.

Referring to FIG. 5, a wall 16 of the article of luggage 10 is shown. In the present embodiment, the wall 16 is made from a wall material that is a reinforced fabric. However, it is to be understood that the wall 16 is not particularly limited to any material and that several variations are contemplated. Some examples of materials which are ideal for the wall 16 are other types of fabric such as leather, plastic polymers, and other materials commonly used in the manufacture of softside luggage. The wall material is shaped to have fastening flaps 30-1, 30-2, 30-3, 30-4 (generically, these fastening flaps are referred to herein as "fastening flap 30" and collectively they are referred to as "fastening flaps 30") extending from wall portions of the wall 16. In the present embodiment, at least a portion of each of the fastening flaps 30 is narrower than the corresponding wall portion such that the fastening flap 30 can be wrapped at least partially under the bottom tray 12 and fitting between the space between a pair of adjacent wheel wells 14. The fastening flap 30 can then be secured to the underside 34 of the bottom tray 12, such as at a fastening point 40. In the present embodiment, the wall 16 is a single piece of fabric without any seams. However, it is to be appreciated with the benefit of this description that the wall 16 is not particularly limited and can be modified to include a single piece of fabric with a seam. In other embodiments, the wall 16 can include two or more pieces of fabric sewn together. A fastening flap 30 may be a region of the same piece of fabric as the wall 16, or the fastening flap 30 may a separate piece of fabric that is sewn (or otherwise attached) to fabric forming the wall 16.

Figure 6:
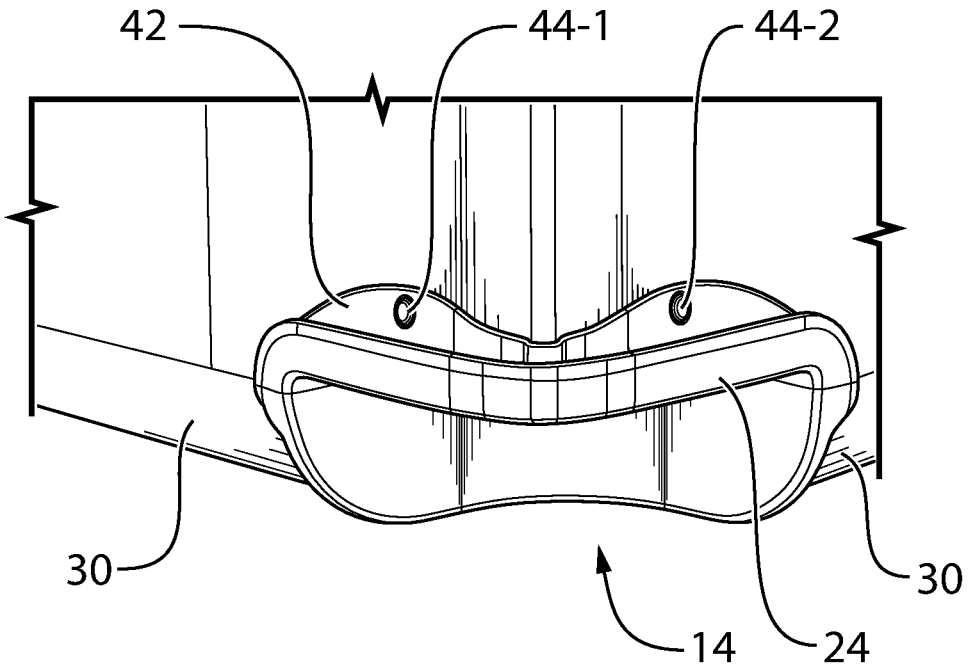
FIG. 6 is a perspective view of a portion of the article of luggage shown in FIG. 1 partially assembled.
Figure 7:
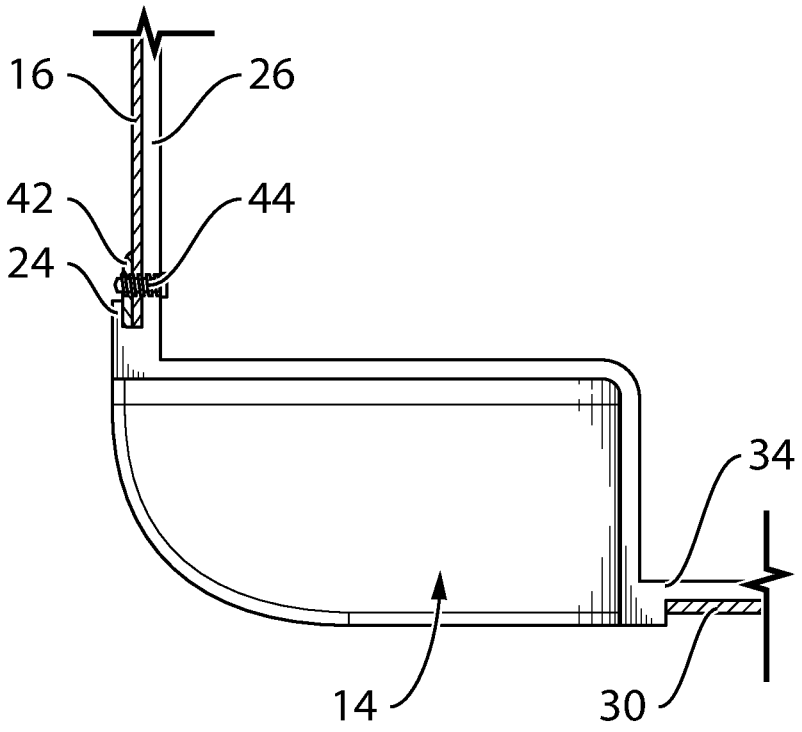
FIG. 7 is a cross section view of the portion of the article of luggage shown in FIG. 6.

FIGS. 6 and 7 show the connection of the bottom tray 12 to the wall 16 at a wheel well 14. In the present embodiment, an interlock piece 42 extends around the corner of the article of luggage at a wheel well 14. The interlock piece 42 is wedged into the gap 28 adjacent and in contact with the wall 16 in the gap 28. The interlock piece 42 is fastened to the outer wall 26 by using the fasteners 44-1 and 44-2 to penetrate through holes in the interlock piece 42 and the bottom tray 12. In the present embodiment, the wall 16 includes holes therein for the fasteners 44-1 and 44-2 to pass through; however, other embodiments can include a wall 16 without holes that the fastener can pierce through. It is to be appreciated that the fasteners 44-1 and 44-2 and the interlock piece 42 are not particularly limited and can be modified, such as having more or less than two fasteners to hold the interlock piece 42 in place. For example, in some embodiments, the fasteners 44-1 and 44-2 can be omitted and the interlock piece 42 can be held in place using a friction fit in the gap 28. The type of fastener 44-1 and 44-2 is also not particularly limited and can be modified to include various fasteners such as rivets, screws, nails and bolts.

The interlock piece 42 is not particularly limited and variations of the present embodiment are contemplated. In particular, the interlock piece 42 can be modified or omitted in some embodiments. For example, in the present embodiment, the interlock piece 42 is a right-angled bracket. However, other embodiments can vary the interlock piece 42 to be one or more elastomer clips configured to retain the wall 16. In further embodiments, the interlock piece 42 can be omitted completely. In such embodiments without the interlock piece, the wall 16 can be held in the gap 28 using a friction fit, adhesives, hook-and-pile fasteners (e.g., Velcro) or other retention mechanisms capable of securing the wall 16 to the bottom tray. In addition or alternatively, the wall 16 can be held in the gap 28 by one or more fastening flaps 30 being pulled and secured tightly, and in such embodiments the interlock pieces 42 or other additional retention mechanism can be omitted.

It is to be re-emphasized that the article of luggage 10 described above is a non-limiting representation only. For example, although the present embodiment shown in FIG. 1 includes a bottom tray having four wheel wells 14, other embodiments can include more or less wheel wells. In addition, the article of luggage 10 can be modified to remove the lips 24 such that the wall 16 is configured to be flush against the bottom tray 12 and held in place using alternative means such as with adhesives.

As another example of a variation, it is to be appreciated that although the wall 16 generally defines a conventional suitcase, it is to be appreciated that that bottom tray 12 can be used in other types of luggage such as a backpack, or a dufflebag having a hard bottom.

Figure 8:
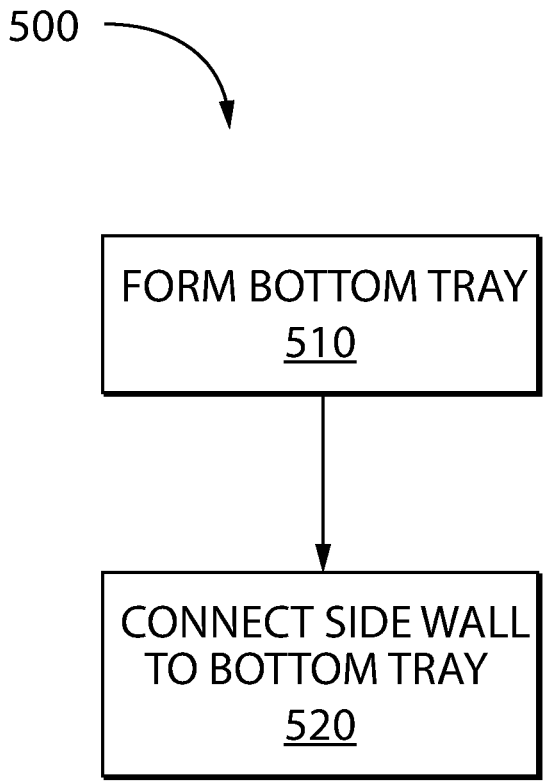
FIG. 8 is a flow chart of a method of assembling an article of luggage in accordance with an embodiment.

Referring now to FIG. 8, a method of manufacturing the article of luggage 10 is indicated generally at 500. Block 510 comprises forming the bottom tray 12 with wheel wells 14 formed therein. The manner by which the bottom tray 12 is formed is not particularly limited and is dependent on the bottom tray material used. For example, in the embodiment discussed above, the bottom tray 12 is made from a hard plastic that is formed using an injection molding process.

In other embodiments, various manufacturing techniques, such as pressure forming and 3D printing can be used for plastics. In further embodiments, such as ones where the bottom tray material is a metal, a stamping process can be used.

Block 520 comprises connecting the wall material to the bottom tray 12 to form the wall 16 of the article of luggage 10. It is to be appreciated by a person of skill in the art with the benefit of this description that the wall 16 can be cut and finished according to a design pattern prior to being connected to the bottom tray. For example, the wall 16 can include several pieces sewn together or bound using other means such as adhesives, hook-and-pile fasteners, or similar. In addition, the preparation of the wall material can also include finishing seams and adding fabric binding and piping.

It is to be appreciated by a person of skill in the art with the benefit of this description that in some embodiments, the method 500 can be completed by separate parties. For example, a plastics manufacturer can be used to form the bottom tray 12 and a separate assembler can be used to connect the wall material to the bottom tray 12.

Figure 9A:
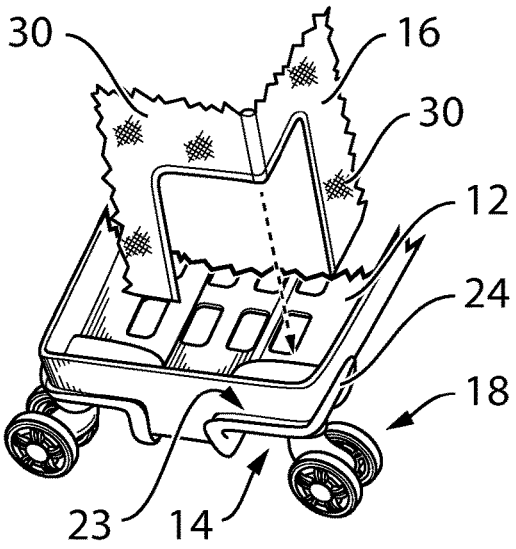
FIGS. 9*a-d* are perspective views of a portion of the article of luggage shown in FIG. 1 at different stages of assembly.
Figure 9B:
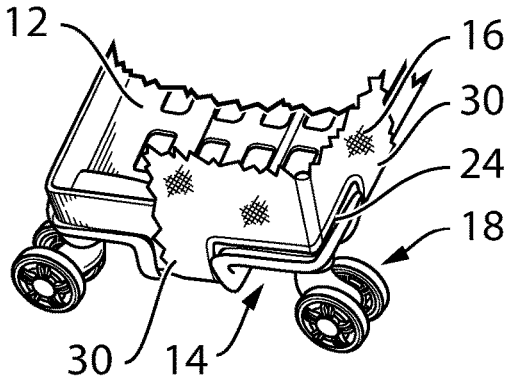
Figure 9C:
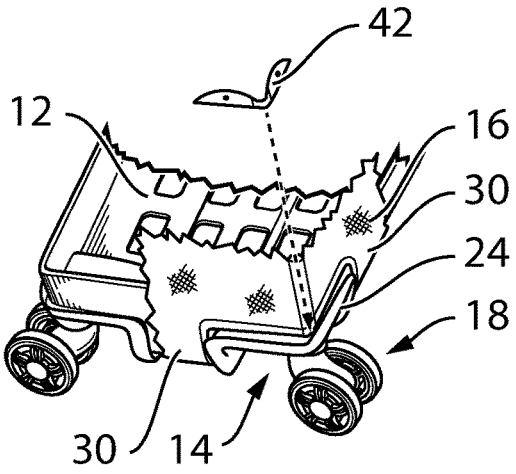
Figure 9D:
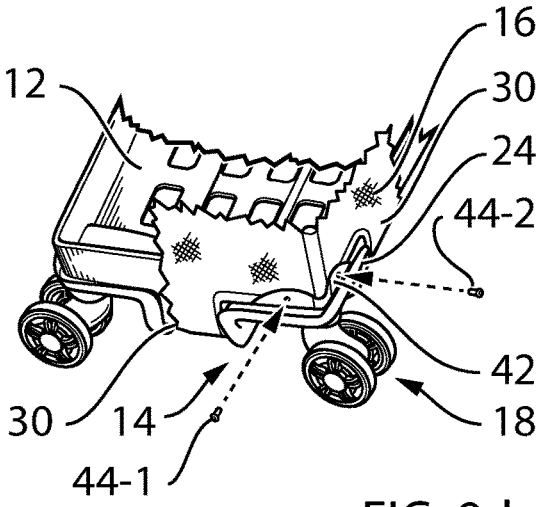
Figure 10A:
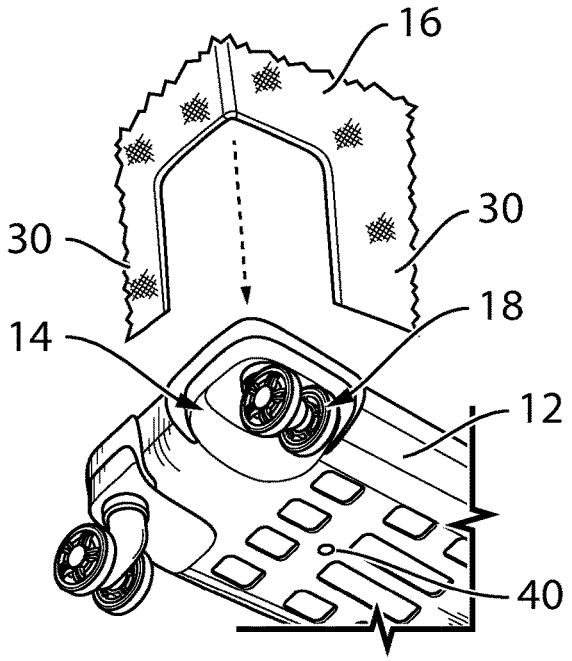
FIGS. 10*a-d* are other perspective views of a portion of the article of luggage shown in FIG. 1 at different stages of assembly.
Figure 10B:
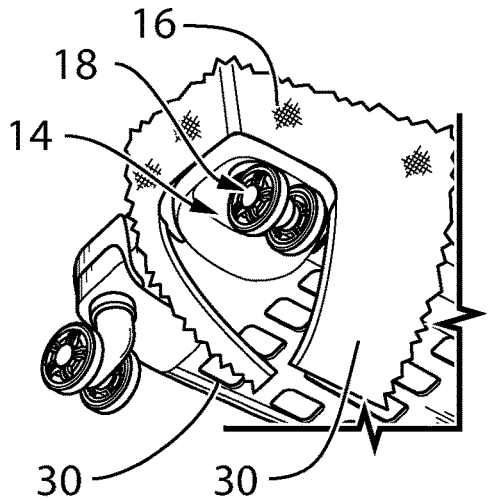
Figure 10C:
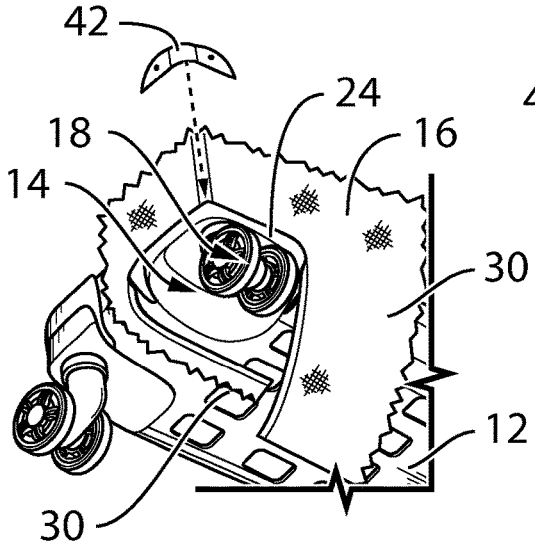
Figure 10D:
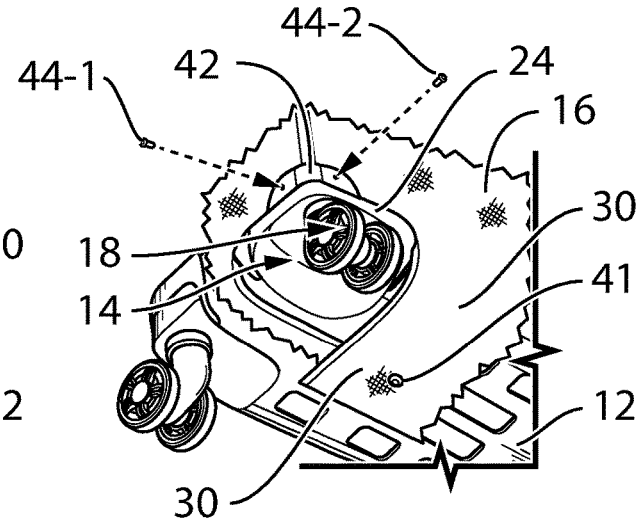

FIGS. 9*a-d* and 10*a-d* show the steps of carrying out block 520 to connect the wall 16 to the bottom tray 12 of the article of luggage 10 from the top view and the bottom view, respectively, in accordance with an embodiment. FIGS. 9*a* and 10*a* show at least a portion of an edge 50 of the wall material is inserted into the gap 28 defined by the lips 24 of the wheel well. FIGS. 9*b* and 10*b* show the fastening flaps 30-1 and 30-2 of the wall 16 being wrapped around the bottom tray 12. FIGS. 9*c* and 10*c* show the interlock piece 42 being wedged into the gap 28 to secure the wall material in the gap 28. FIGS. 9*d* and 10*d* show the interlock piece 42 being and fastened to the bottom tray 12 using the fasteners 44-1 and 44-2. In addition, the fastening flaps 30 of the wall material are wrapped at least partially under the bottom tray 12 and secured to the bottom tray 12 at the fastening point 40 using a fastener 41. The manner by which the fastening flaps 30 are secured is not particularly limited. For example, in the present embodiment, it is shown that one fastening flap 30 is secured over the other fastening flap 30; however, in other embodiments, the fastening flaps can be reversed such that the one on the bottom becomes the one on the top. In addition, although the fastener 41 is used to secure the fastening flaps 30 to the bottom tray, other manners for securing the fastening flaps 30 can either be alternatively used or used in combination with the fastener 41. For example, the fastening flaps 30-1 and 30-2 can be secured using adhesives, clips and/or sewn into the bottom tray.

It is to be appreciated that in the present embodiment, the wheel wells are not covered by the wall 16. Accordingly, the wheel wells 14 expose the bottom tray 12 as an external surface within the wheel wells 14. It is to be appreciated by a person of skill in the art that this provides advantages in to the manufacturing of the article of luggage. In particular, since the wall 16 does not overlap the wheel well 14, the attachment of the wall and the spinner wheels 18 are completely independent. Therefore, the spinner wheels 18 can be directly attached to the bottom tray 12 equally easily at any time either before or after attaching the wall 16 providing greater flexibility in the manufacturing process of the article of luggage. Increased accuracy in spinner wheel 18 positioning and orientation is also an advantage of the unitary bottom tray 12. More accurately positioned spinner wheels 18 can help the user better control the article of luggage 10 when in motion.

Figure 11:
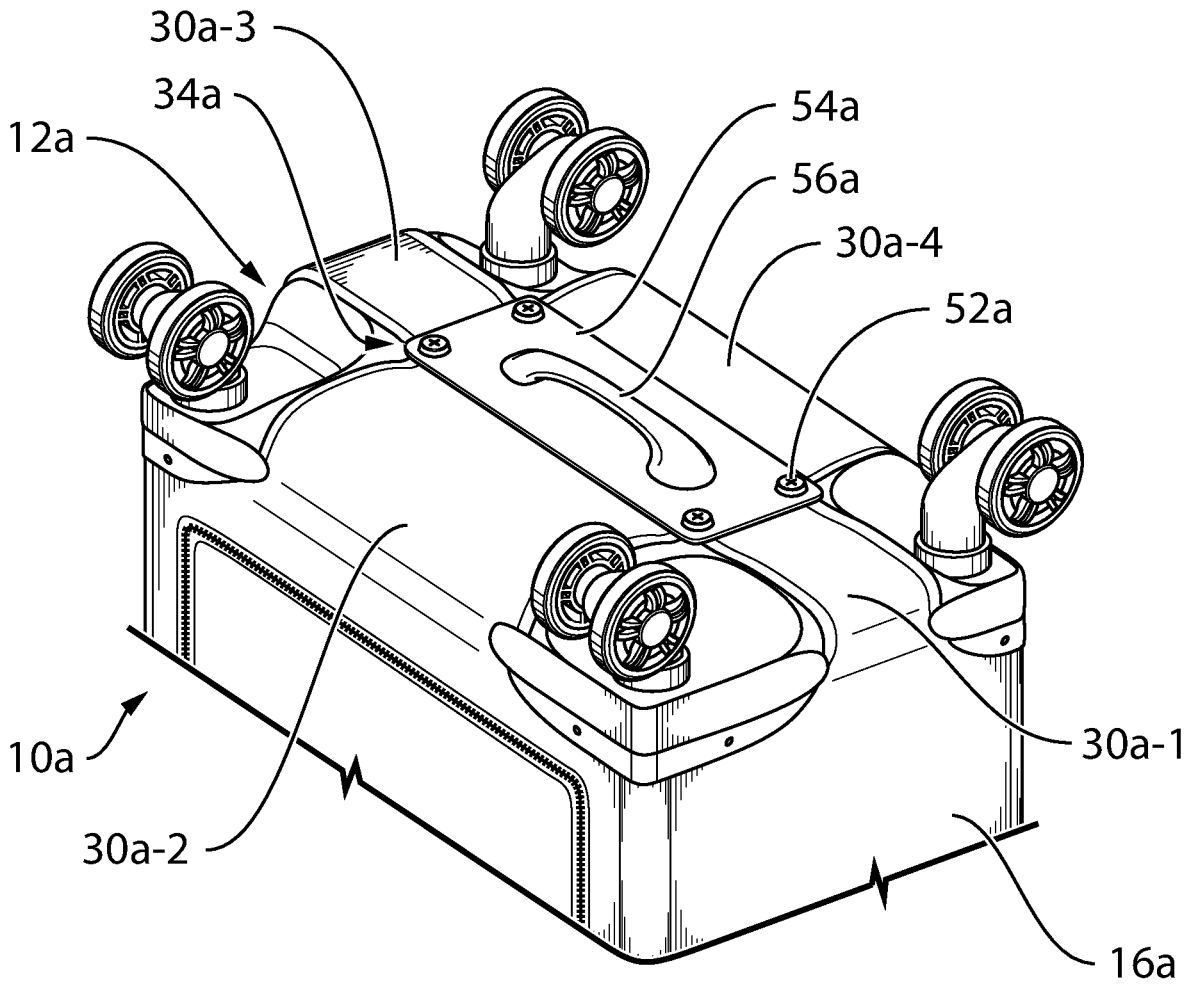
FIG. 11 is a perspective view of a portion of the article of luggage in accordance with another embodiment.

Referring to FIG. 11, the bottom portion of another embodiment of an article of luggage 10*a* is shown. Like components of the article of luggage 10*a* bear like reference to their counterparts in the article of luggage 10, except followed by the suffix "a". The article of luggage 10*a* includes a wall 16*a* and a bottom tray 12*a*. In the present embodiment, the fastening flaps 30*a*-1. 30*a*-2, 30*a*-3, and 30*a*-4 of the wall 16*a* are wrapped around the bottom tray 12*a*. The wall 16*a* is fastened to the bottom tray 12*a* using an interlock pieces 42*a*-1, 42*a*-2, 42*a*-3, and 42*a*-4. The wall 16*a* is further secured to the bottom tray 12*a* using a plate 54*a* fastened to the underside 34*a* using fasteners 52*a*. In the present embodiment, the plate 54*a* is a hard plastic, such as polyproylene and generally configured to firmly secure the wall 16*a* against the bottom tray 12*a*. However, it is to be understood that the plate 54*a* is not particularly limited to any material and that several variations are contemplated, such as the use of more than one such plate 54*a*. Some examples of materials which are ideal for the plate 54*a* are aluminum, titanium, carbon fiber composites, and other materials that can firmly hold the wall 16*a* against the underside 34*a* of the bottom tray 12*a*.

In the present embodiment, the plate 54*a* further includes an optional handle 56*a*. It is to be appreciated by a person of skill in the art with the benefit of this description that that the handle 56*a* is not particularly limited and can be varied. The handle 56*a* is generally configured to provide a user of the article of luggage 10*a* with a convenient way to lift the article of luggage 10*a*. Accordingly, the handle 56*a* can be modified to any design that increases user comfort, such as including ergonomic hand grips or reduces the costs of manufacturing using a simple design. In the present embodiment, the handle 56*a* can be a separate component attached to the plate 54*a*. However, in other embodiments, the handle 56*a* can be formed with the plate 54*a* as a single unitary component.

Figure 12:
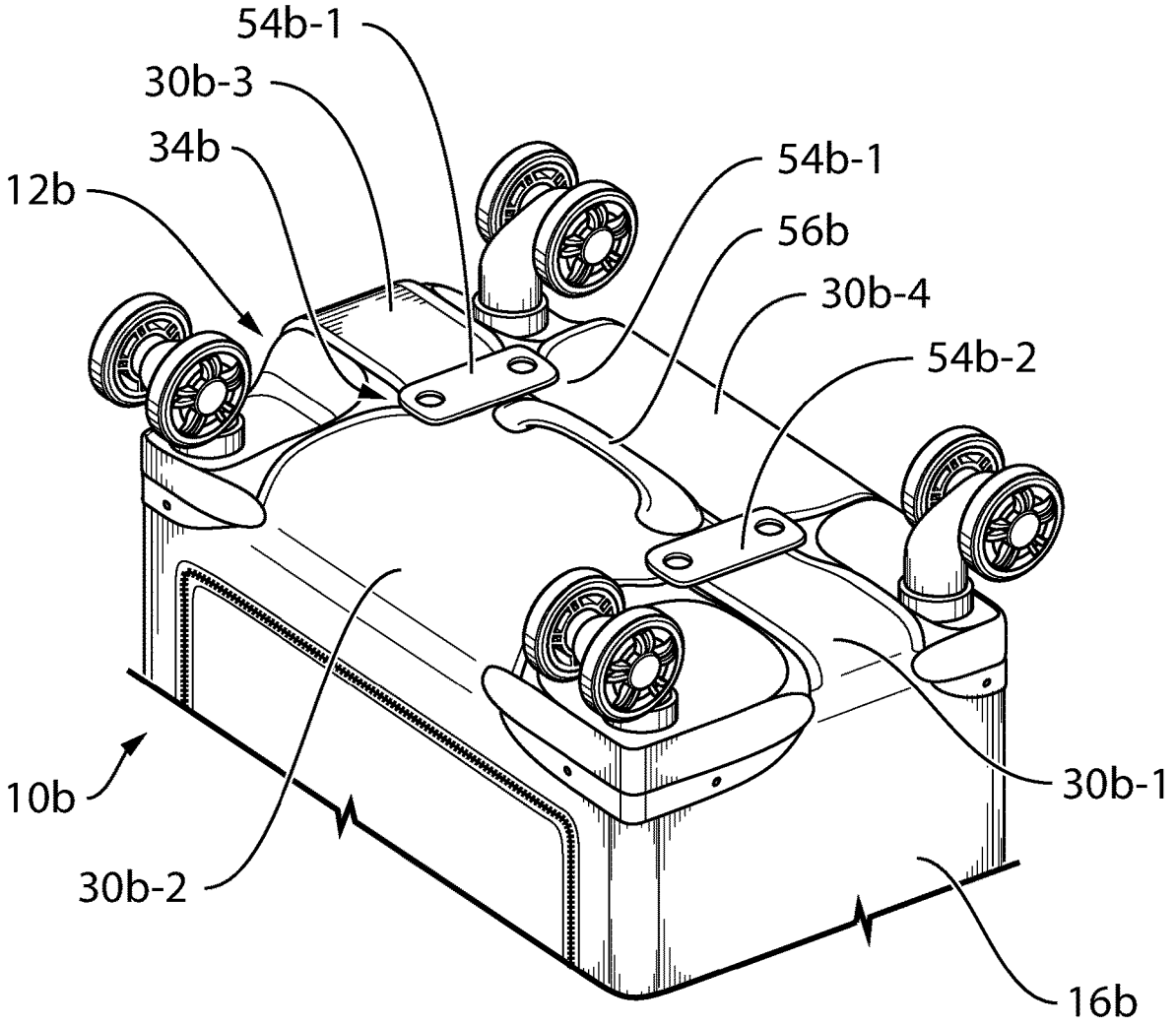
FIG. 12 is a perspective view of a portion of the article of luggage in accordance with another embodiment.

Referring to FIG. 12, the bottom portion of another embodiment of an article of luggage 10*b* is shown. Like components of the article of luggage 10*b* bear like reference to their counterparts in the article of luggage 10 and the article of luggage 10*a*, except followed by the suffix "b". The article of luggage 10*b* includes a wall 16*b* and a bottom tray 12*b*. In the present embodiment, the fastening flaps 30*b*-1. 30*b*-2, 30*b*-3, and 30*b*-4 of the wall 16*b* are wrapped around the bottom tray 12*b*. The wall 16*b* is fastened to the bottom tray 12*b* using a interlock piece 42*b*. The wall 16*a* is further secured to the bottom tray 12*a* using brackets 54*b*-1 and 54*b*-2 (generically, these brackets are referred to herein as "bracket 54*b*" and collectively they are referred to as "brackets 54*b*") fastened to the underside 34*b*. In the present embodiment, a bracket 54*b* is a hard plastic such as polyproylene and generally configured to firmly secure the wall 16*b* against the bottom tray 12*b*. However, it is to be understood that the brackets 54*b* are not particularly limited to any material and that several variations are contemplated. Some examples of materials which are ideal for the brackets 54*b* are aluminum, titanium, carbon fiber composites, and other materials that can firmly hold the wall 16*b* against the underside 34*b* of the bottom tray 12*b*.

In the present embodiment, the article of luggage 10*b* further includes an optional handle 56*b*. It is to be appreciated by a person of skill in the art with the benefit of this description that that the handle 56*b* is not particularly limited and can be varied. In the present embodiment, the handle 56*b* is generally configured to provide a user of the article of luggage 10*b* with a convenient way to lift the article of luggage 10*b* and is connected directly to the bottom tray 12*b* through the fastening flaps 30*b*. Accordingly, the handle 56*b* can be modified to any design that increases user comfort, such as including ergonomic hand grips or reduces the costs of manufacturing using a simple design. In the present embodiment, the handle 56*b* is a separate component attached to the bottom tray 12*b*. However, in other embodiments, the handle 56*b* can be connected to and/or formed with the brackets 54*b* or the bottom tray 12*b*. In other embodiments, the handle 56*b* is formed by the top-most fastening flap, which can have an opening cut therein or which can be shaped to provide an opening. In still other embodiments, the handle is omitted.

Figure 13:
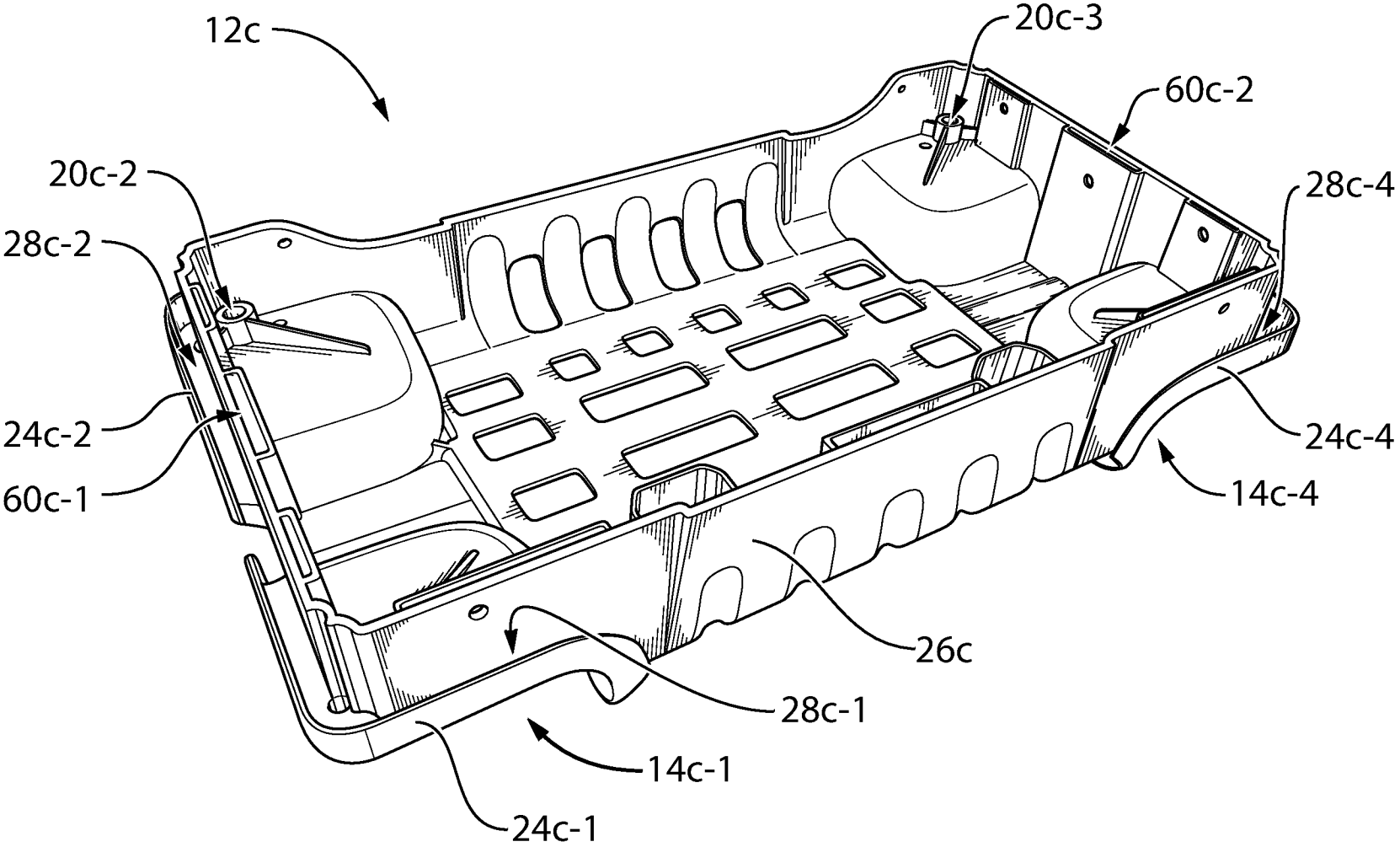
FIG. 13 is a perspective view of a bottom tray according to another embodiment.
Figure 14:
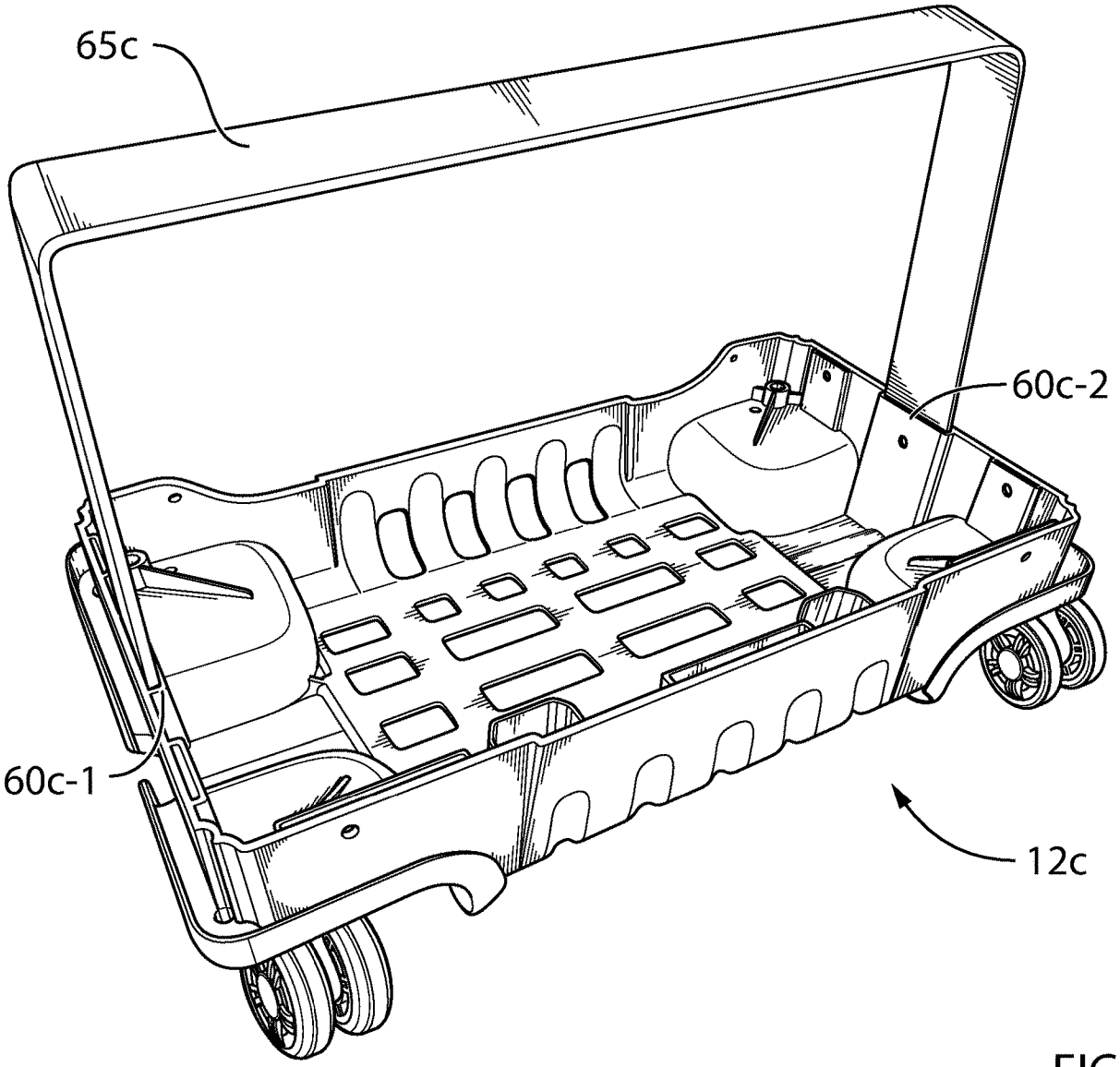
FIG. 14 is a perspective view of the bottom tray and frame according to the embodiment shown in FIG. 13.

Referring to FIGS. 13 and 14, another embodiment of the bottom tray 12*c* is shown. Like components of the bottom tray 12*c* bear like reference to their counterparts in the bottom tray 12, except followed by the suffix "c". The bottom tray 12*c* includes additional slots 60*c*-1 and 60*c*-2 (generically, these slots are referred to herein as "slot 60*c*" and collectively they are referred to as "slots 60*c*"). The slot 60*c* is generally configured to receive a frame 65*c* to provide structural

What is claimed is:

1. An article of luggage comprising:

a bottom tray having wheel wells formed therein, the bottom tray being made from a bottom-tray material;

a wall connected to the bottom tray, the wall made from a wall material that is softer than the bottom-tray material; and spinner wheels connected directly to the bottom tray at the wheel wells;

wherein the wall material is shaped to include at least one fastening flap extending from a wall portion of the wall material, wherein the bottom tray further comprises a lip positioned at least along a portion of a perimeter of at least one of the wheel wells, the lip offset from an outer wall of the bottom tray defining a gap, the gap fitting an edge of the wall material.

2. The article of luggage of claim 1, wherein the bottom-tray material comprises hard plastic.

3. The article of luggage of claim 1, wherein the wall material comprises fabric.

4. The article of luggage of claim 1, wherein the bottom tray is a unitary construction.

5. The article of luggage of claim 1, wherein the bottom tray is manufactured using an injection molding process.

6. The article of luggage of claim 1, further comprising a handle at an underside of the bottom tray.

7. The article of luggage of claim 1, wherein the lip is integral with the bottom tray.

8. The article of luggage of claim 1, wherein the lip is removable from the bottom tray.

9. The article of luggage of claim 1, wherein the lip is configured to protect a corner of the article of luggage.

10. The article of luggage of claim 1, wherein the fastening flap is narrower than the wall portion and wrapped at least partially under the bottom tray, the fastening flap being secured to an underside of the bottom tray.

11. The article of luggage of claim 1 further, comprising slots to receive a frame to reinforce the article of luggage.

12. The article of luggage of claim 11, wherein the slots are positioned at opposing inner walls of the bottom tray.

* * * * *